United States Patent [19]

Ide

[11] 4,059,724

[45] Nov. 22, 1977

[54] SHIELD WIRE

[76] Inventor: Homare Ide, 22, Hazawa 2-Chome, Nerima, Tokyo, Japan

[21] Appl. No.: 667,032

[22] Filed: Mar. 15, 1976

[30] Foreign Application Priority Data

Mar. 22, 1975 Japan ..... 50-37197[U]

[51] Int. Cl.[2] ..... H01B 11/06

[52] U.S. Cl. ..... 174/36; 174/102 R; 174/107; 174/120 SC

[58] Field of Search ..... 174/36, 102 R, 102 SC, 174/105 SC, 107, 120 SC

[56] References Cited

U.S. PATENT DOCUMENTS

| | | | |
|---|---|---|---|
| 3,433,891 | 3/1969 | Zysk et al. | 174/102 SC X |
| 3,591,704 | 7/1971 | Ebel | 174/105 SC |
| 3,643,004 | 2/1972 | McKean | 174/105 SC X |
| 3,707,595 | 12/1972 | Plate | 174/105 SC X |
| 3,843,830 | 10/1974 | Priaroggia et al. | 174/102 SC |
| 3,885,085 | 5/1975 | Bahder et al. | 174/102 SC |
| 3,917,900 | 11/1975 | Arnaudin, Jr. | 174/106 SC X |
| 3,943,271 | 3/1976 | Bahder et al. | 174/105 SC X |

*Primary Examiner*—Arthur T. Grimley
*Attorney, Agent, or Firm*—Wenderoth, Lind & Ponack

[57] ABSTRACT

A shield wire includes an inner conductor, a first dielectric surrounding the inner conductor, a second dielectric of Japanese paper placed over the first dielectric, a middle conductor relatively high in resistance placed over the second dielectric, a braid of copper alloy woven over the middle conductor to form an outer conductor, and a covering of elastic dielectric placed on top of said braid, thereby to prevent not only the influence of induction hum due to external magnetic fields but also the generation of noise signals due to bending of a shield wire.

5 Claims, 2 Drawing Figures

SHIELD WIRE

BACKGROUND OF THE INVENTION

This invention relates to shield wires employed, for instance, in a circuit (such as that between a microphone and an amplifier) for precisely transmitting variations of electrical current.

A conventional shield wire comprises either a solid or stranded-wire inner conductor of copper alloy or the like surrounded by an electrical insulating material or a dielectric material such as vinyl or the like. A braid of copper alloy or the like is woven over the dielectric material to form the outer conductor, and a covering of elastic dielectric such as synthetic rubber is placed on top of the braid.

With the conventional shield wire, it is possible to reduce the influence of induction hum due to external magnetic fields to some extent with the aid of the braid. However, in the case when the shield wire is extremely bent during the operation of an electrical device provided with the shield wire, it is difficult to precisely transmit the variations of electrical current therethrough. For instance, it is well known in the art that when a cable connected to a microphone is extremely bent during operation, noise signals are generated.

A cause of this effect is considered to be that at the moment when the shield wire is bent, static electricity is generated in the braid and accordingly the electrostatic capacitance between the braid and the inner conductor is changed, as a result of which electrical current corresponding to the change of the electrostatic capacitance is caused to flow in the circuit, which leads to the generation of noise signals.

SUMMARY OF THE INVENTION

Accordingly, an object of this invention is to provide a shield wire which can prevent not only the effect of induction hum due to external magnetic fields but also the generation of noise due to the bending of the shield wire.

Another object of this invention is to provide a shield wire which is simple in construction.

The foregoing object and other objects of this invention have been achieved by the provision of a shield wire which comprises an inner conductor of metal, a first dielectric surrounding the inner conductor, a middle conductor relatively high in resistance placed over the first dielectric, a braid of metal woven over the middle conductor to form an outer conductor, and a covering of elastic dielectric placed on top of the braid.

The nature, principle and utility of this invention will become more apparent from the following detailed description and the appended claims when read in conjunction with the accompanying drawings.

BRIEF DESCRIPTION OF THE ACCOMPANYING DRAWINGS

In the accompanying drawings:

FIG. 1 is a sectional view illustrating one example of a shield wire according to the invention; and FIG. 2 is a perspective view illustrating the shield wire according to the invention.

DETAILED DESCRIPTION OF THE INVENTION

Figure 1:
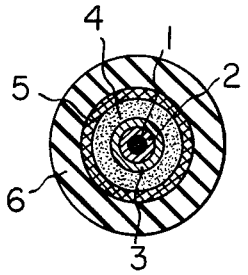
Figure 2:
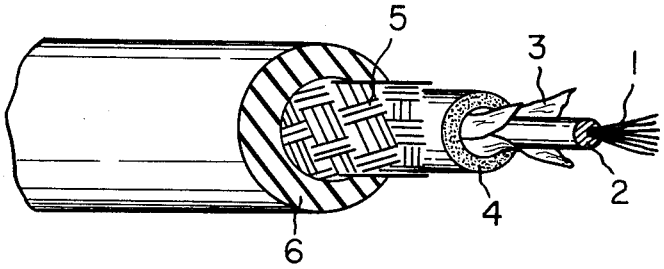

With respect to the FIGS. 1 and 2 of the accompanying drawing, one example of a shield wire according to this invention will be described.

The shield wire, as shown in these figures, comprises: a core, that is, an inner conductor 1 made of copper alloy or the like placed in the central part thereof; a first dielectric 2 of, for instance, vinyl which surrounds the inner conductor 1; and a second dielectric 3 made of material such as thin Japanese paper, which is wrapped over the first dielectric 2. The material of the second dielectric 3 is not limited to Japanese paper, that is, it may be cellophane or cotton tape. For instance, the second dielectric may be obtained by winding cotton thread over the first dielectric 2. However, according to several experiments, the best result was obtained when a long fibered Japanese paper in the form of a thin film which has been conventionally produced in Japan was employed as the second dielectric for the shield wire.

The shield wirc according to this invention further comprises: a middle conductor 4 made of a mixture of carbon powder and plastic such as vinyl so as to have a relatively high electrical resistance which conductor is placed over the second dielectric or Japanese paper 3; braid 5 of copper alloy or the like woven over the high resistance conductor 4 to form the outer conductor; and a covering 6 of elastic material such as synthetic rubber placed on top of the braid 5.

One of the specific features of this invention resides in the provision of the middle conductor 4 in the shield wire. The middle conductor 4, as was described above, is made of carbon which is electrically conductive material and plastic which is electrically non-conductive material. Accordingly, the resistance of the middle conductor 4 is relatively high, that is, it is a so-called semiconductor. Therefore, under normal conditions, electrical current flows through the braid 5, but it scarcely flows into the middle conductor 4 of carbon-plastic. On the other hand, under abnormal conditions, that is, in the case when the shield wire as fabricated above is bent or deformed and accordingly the braid is bent or deformed and static electricity is therefore generated as was described above, the charge at the portion of the braid thus bent is increased and a part of the charge particles move to the middle conductor 4. Because of this charge particle movement, the influence of the static electricity thus caused can be prevented, that is, the circuit can be protected from the noise signals which would otherwise occur.

The second dielectric 3 of Japanese paper is to improve the insulation between the first dielectric 2 and the middle conductor 4.

As is apparent from the above, according to the invention a novel shield wire which is relatively simple in construction and which can prevent not only the effect of induction hum due to external magnetic fields but also the generation of noise signals due to the bending of the shield wire is provided.

What is claimed is:

1. A shield wire comprising:
an inner conductor of metal;
a first dielectric surrounding said inner conductor;
a second dielectric placed on top of said first dielectric;

a middle conductor formed of a mixture of carbon powder and plastic and having a relatively high resistance placed over said second dielectric;

a braid of metal woven over said middle conductor to form an outer conductor; and a covering of electric dielectric placed on top of said braid.

2. A shield wire as claimed in claim 1 wherein said second dielectric is a Japanese paper wrapped over said first dielectric.

3. A shield wire as claimed in claim 1 wherein said second dielectric is a cellophane surrounding said first dielectric.

4. A shield wire as claimed in claim 1 wherein said second dielectric is cotton tape placed over said first dielectric.

5. A shield wire as claimed in claim 1, wherein said second dielectric is cotton thread wound on said first dielectric.

* * * * *